US007370823B2

(12) United States Patent
Lämmermann et al.

(10) Patent No.: US 7,370,823 B2
(45) Date of Patent: May 13, 2008

(54) METHOD AND DEVICE FOR LAYING OF ELONGATED WINDING MATERIAL

(75) Inventors: Helmut Lämmermann, Schwabach (DE); Rudolf Bader, Marktoberdorf (DE); Wolfgang Beck, Schwabsoien (DE); Bernhard Enzensberger, Wald (DE)

(73) Assignee: Maschinenfabrik Niehoff GmbH & Co. KG, Schwabach (DE)

( * ) Notice: Subject to any disclaimer, the term of this patent is extended or adjusted under 35 U.S.C. 154(b) by 0 days.

(21) Appl. No.: 11/788,554

(22) Filed: Apr. 20, 2007

(65) Prior Publication Data

US 2007/0284472 A1 Dec. 13, 2007

(30) Foreign Application Priority Data

Apr. 20, 2006 (DE) ..... 10 2006 018 428

(51) Int. Cl.
*B65H 57/28* (2006.01)

(52) U.S. Cl. ..... 242/397.2; 242/413.2; 242/548.1

(58) Field of Classification Search ..... 242/397, 242/397.1, 397.2, 397.3, 397.5, 386, 413, 242/413.1, 413.2, 548, 548.1, 534, 441, 441.1, 242/447, 447.1, 273, 277–279
See application file for complete search history.

(56) References Cited

U.S. PATENT DOCUMENTS 3,862,723 A * 1/1975 Bonikowski ..... 242/413.2
4,668,544 A * 5/1987 Takahashi ..... 242/447.1
5,564,637 A * 10/1996 Berthold et al. ..... 242/447
6,012,668 A * 1/2000 Zurfluh et al. ..... 242/397.3
6,073,878 A * 6/2000 Egglhuber ..... 242/397.2
6,131,845 A * 10/2000 Burlingame et al. ..... 242/447.1
6,247,664 B1 * 6/2001 Petersen et al. ..... 242/413.2
6,443,431 B1 * 9/2002 Stasny et al. ..... 242/548.1

FOREIGN PATENT DOCUMENTS

JP 55-31776 * 3/1980 ..... 242/397.3

* cited by examiner

*Primary Examiner*—William A Rivera
(74) *Attorney, Agent, or Firm*—Greer, Burns & Crain, Ltd.

(57) ABSTRACT

A method for laying elongated winding material, such as for example wire, insulated or non-insulated strands, glass fibers, and the like, in which the strand-type material is wound in layers onto rotationally symmetrically shaped winding spools, the winding material being guided to a winding spool via a deflecting roller for the laying, and for the distribution on the winding spool the deflecting roller is moved essentially parallel to the axial direction, a sensor unit acquiring the position of the spool flange as well as the winding diameter of the winding material, and control signals for the movement of the deflecting roller being derived from the measurement values of the sensor unit.

16 Claims, 3 Drawing Sheets

METHOD AND DEVICE FOR LAYING OF ELONGATED WINDING MATERIAL

BACKGROUND

The present invention relates to a method for laying elongated winding material, such as for example wire, insulated or non-insulated strands, glass fibers, and the like, as well as a device for executing the method.

In known winding methods, a strand-type material is for example attached to a rotating spool and is thus wound onto the core of the spool. In order to achieve a layered winding, i.e. to lay the wire windings next one another on the spool, a deflection roller that guides the winding material to the spool moves essentially parallel to the axial direction of the rotating spool. It is also known to situate the spool in stationary fashion and to cause a flyer that also moves axially to move around the spool, said flyer laying the winding material around the spool in layers.

In order to obtain a particular type of winding (layer on layer), it is also known to cause the axially displaceable laying unit on which the deflecting roller is situated to trail the normal pitch direction by a certain amount. In this way, between the material being wound on and the winding already in place there arises a lateral pressure that lays the winding material in the desired manner up to the last winding of the relevant layer.

If the laying unit does not reverse its direction of motion at the correct time, the winding material reaches the flange of the spool. It climbs onto the last winding of the completely wound layer and, if the change of direction still does not take place, forms what is called a "hill" in the winding directly on the flange.

Here, when the change of direction of the laying unit takes place too late, there results an axial pressure on the spool flange, which deforms elastically as a result, in particular in the case of plastic spools. On the one hand, this has a disadvantageous effect on the durability of the plastic spools, and on the other hand the elastic reset forces of the flange cause problems in the later unwinding of the elongated winding material from the spool.

Immediately after the change of direction of the laying unit in the winding process, the counter-pressure of a previous winding is not present. For this reason, the winding material at this location has the tendency to wind on with larger spacings at the beginning, i.e. with a larger pitch, dependent on the size of the feeding angle. In this way, at the beginning of each winding layer there arise intermediate spaces, called "valleys," into which the windings of the layer situated thereabove are wound, which can cause difficulties in the later unwinding of the winding material.

However, if the change of direction of the laying unit takes place too late, as mentioned above a plurality of windings overlap at the relevant spool flange. Such piles of winding layers are called hills. As a result of these phenomena, non-uniform layers are formed, especially in the edge areas of the winding.

The formation of hills and valleys is also caused by an improper setting of the laying width of the winding material, or, as mentioned, by a deformation of the spool flange.

In addition to the non-uniform and therefore unsatisfactory use of the winding space caused by the formation of hills and valleys, the winding material is also excessively stressed, and can thus be damaged.

Therefore, for the most optimal use of the winding space, as well as in order to avoid an elastic deformation of spool flanges, it should be sought to avoid the formation of hills and valleys during the layered laying of the winding material.

For the purpose of speed synchronization, control devices, known as "dancers," are known that influence either the running speed of the spool or the running speed of the flyer circulating around the spool. In order to detect hills and valleys, for example the speed of the winding material is determined via the dancer signal or by an analog tachometer. These methods supply relatively imprecise signals on the basis of which no conclusion can be drawn concerning the amplitudes of the hills and valleys.

From DE 196 45 992 A1, a control device is known that has a rotational speed sensor for determining the rotational speed of a flyer or of a winder, and has a control unit for picking up signals of the rotational speed sensor, and has a laying unit for applying the elongated winding material onto the spool. For the controlling of the laying unit, the control unit can control the laying unit corresponding to a determined laying speed target value, and carry out a laying width adjustment. An automatic laying width adjustment can also be realized. Here, for example the tolerances of the spool are taken into account, or also the change in spool dimensions that can result from an elastic deformation of the flange during winding. In addition, the control unit can carry out an automatic reverse point correction. At slow rotational speeds, the laying width deviation is determined by modifying the rotational speed in relation to a reference rotational speed that is measured at the center of the spool. At higher rotational speeds, a dancer signal is used that controls the winder.

For the digital detection of hills and valleys, other known systems use as a parameter the wire feed length, relative to a particular number of spool rotations. Here, an average diameter on the spool is determined, and this is compared with the diameters at the reverse points.

A disadvantage of both these systems is the indirect detection of the winding quality on the basis of parameters such as rotational speed, wire feed length, or laying speed. A laying width adjustment cannot be carried out until deviations of these parameters occur or the spool flange is already deformed, i.e., until a "significantly" non-uniform winding pattern has already occurred.

In DE 200 084 05 U1, it is proposed that a laser distance sensor be attached in such a way that its laser beam forms a line that is aligned with the wire that is to be spooled. This laser distance sensor acquires the distance to a winding material wound onto a spool body, and outputs the value to an SPS control unit. This control unit compares the value with stored data, calculates and evaluates modifications, and sends control signals to a laying unit, which as a result changes its speed so that a uniform winding on the spool results. Here, the laser distance sensor also recognizes the flange of the spool body. This large distance change is evaluated in the control unit as a turning signal, and results in an automatic reversal of the direction of movement of the laying unit.

A disadvantage of this system is that the laser distance sensor acquires only the distance from the deflecting roller to the winding material. The diameter of the winding is not determined, and is not taken into account. It is true that in this way a signal can be derived for accelerating or retarding the shifting unit, but an exact calculation of the speed of the laying device required for the compensation of the non-uniform surface is not possible in the manner described.

Due to the situation of the laser distance sensor, which is aligned with the winding material that is to be spooled, the spool flange is not recognized until the laying unit with the winding material is positioned at the height of the spool flange. The optimum time for reversing the direction of travel of the laying unit is then already past. This results in an elastic deformation of the spool flange and the formation of a hill leaning on the flange.

The use of the known method for improving the winding pattern in the laying of winding material is also made more difficult if the supply of energy and the exchange of signals, such as in the case of stranding machines, is possible only via rotating components.

The present invention is based on the object of making available a method for laying elongated winding material that produces the best possible winding pattern on arbitrary spools, without hills and valleys. In addition, the method should be as user-friendly as possible, and should be capable of being used with all spool systems. In addition, a device is to be indicated for the execution of this method that enables the supply of energy and the exchange of signals via rotating components.

SUMMARY

The method according to the present invention makes it possible to achieve the best possible winding pattern, without hills and valleys, on arbitrary spools while simultaneously avoiding an elastic deformation of the spool flange, and has significant advantages relative to the methods known from the prior art.

It is particularly advantageous if the winding spool rotates during the winding process. In this case, a laying unit that moves back and forth is then used that guides the strand-type material into the desired position at the spool, and moves essentially parallel to the axis of the spool. Here, the spool can be situated horizontally or also vertically.

In another advantageous development of the method according to the present invention, the winding spool stands still during the winding process. In this case, the laying device moves, with what is called a flyer, around the spool on an essentially cylindrical surface, while laying the winding material onto the winding spool.

The winding material is guided to the spool via a deflecting roller that is situated on the laying unit. The method according to the present invention preferably uses a sensor device having at least one laser distance sensor that operates according to the triangulation method and is also situated on the laying unit.

In order to measure the distance of the winding material or of the spool body from the laying unit, it is possible to use sensors that acquire the propagation time of sound waves, light waves, for example in the visible or infrared range, or in general electromagnetic waves, in particular in the microwave range, and that evaluate them, preferably according to the triangulation method. Here, if pulses are sent out, it is for example also possible to use the pulse run-time method to determine the distance value. In addition, sensors having a laser or LED light source can also be used that preferably use the triangulation method to determine the measurement value.

In the method according to the present invention, during the travel of the laying unit the sensor unit measures the spool as well as the position of the spool flange, and thus determines the spool angle, the winding material angle, and the hills and valleys of the winding. In order to control the method, preferably no fixed spool geometries are pre-specified, so that this method can be used with all known spool shapes, such as cylindrical, conical, and biconical spools.

Preferably, using a speed measurement device the feeding speed of the winding material is additionally acquired, and on the basis of the determined values the target value is derived for the position controlling of the laying unit, as well as for the drive speed of the winding spool or of the flyer.

In the method according to the present invention, the sensor unit is also used for the recognition of the spool flange. Here, preferably each time there is a laying stroke the position of the flange is determined on the basis of the measurement value changes of the sensor unit, and the values are used for the subsequent controlling of the change of direction. Preferably, the method according to the present invention automatically provides the necessary tracking of the reverse points. This permanent correction of the reverse points prevents the undesired formation of hills or valleys in the winding material at the flange. In addition, there results a very high degree of user-friendliness, because no correction of the reverse points is required on the part of the person operating the equipment. In addition, this function is independent of the winding laying pattern used.

If, for example, the spool is wound according to the winding method published in patent specification EP 0 334 211 B1, an acquisition of the spool or winding material angle provided in the method according to the present invention is required. In the laying according to the pattern described in this patent specification, the spool core is purposely wound in an oblique manner. In the method according to the present invention, on the basis of the sensor unit the winding material angle can be measured, monitored, and subsequently controlled using a suitable laying controlling. For this purpose, the method provides that the spool diameter at both sides of the spool just before the flange is stored. Using the difference in the spool diameters ($d_1$ and $d_2$) and the distance between the measurement points (length l), the angle of the winding material can be calculated as follows:

$$\alpha=\arctan(l/d_1-d_2)$$

Through the determination of the spool or winding material angle and the automatic flange recognition, it is possible to use this method independent of the construction of the spool. The determined angle is taken into account in the controlling of the automatic laying, or in the flange recognition. Thus, for example an oblique winding as described in EP 0 334 211 B1, as well as laying on cylindrical, conical, and biconical spools, can be controlled. Here, after the acquisition of valleys, the winding speed can be reduced by reducing the rotational speed of the spool or of the flyer, and/or the axial speed of the laying unit can be throttled. Given an acquisition of hills, in order to restore a uniform winding pattern the winding speed can be increased, and/or what are known as shift steps of the laying unit can be executed in the direction of the spool axis.

BRIEF DESCRIPTION OF THE DRAWINGS

Additional advantages, features, and possible applications of the present invention result from the following description in combination with the Figures.

DETAILED DESCRIPTION OF THE PREFERRED EMBODIMENT

Figure 1:
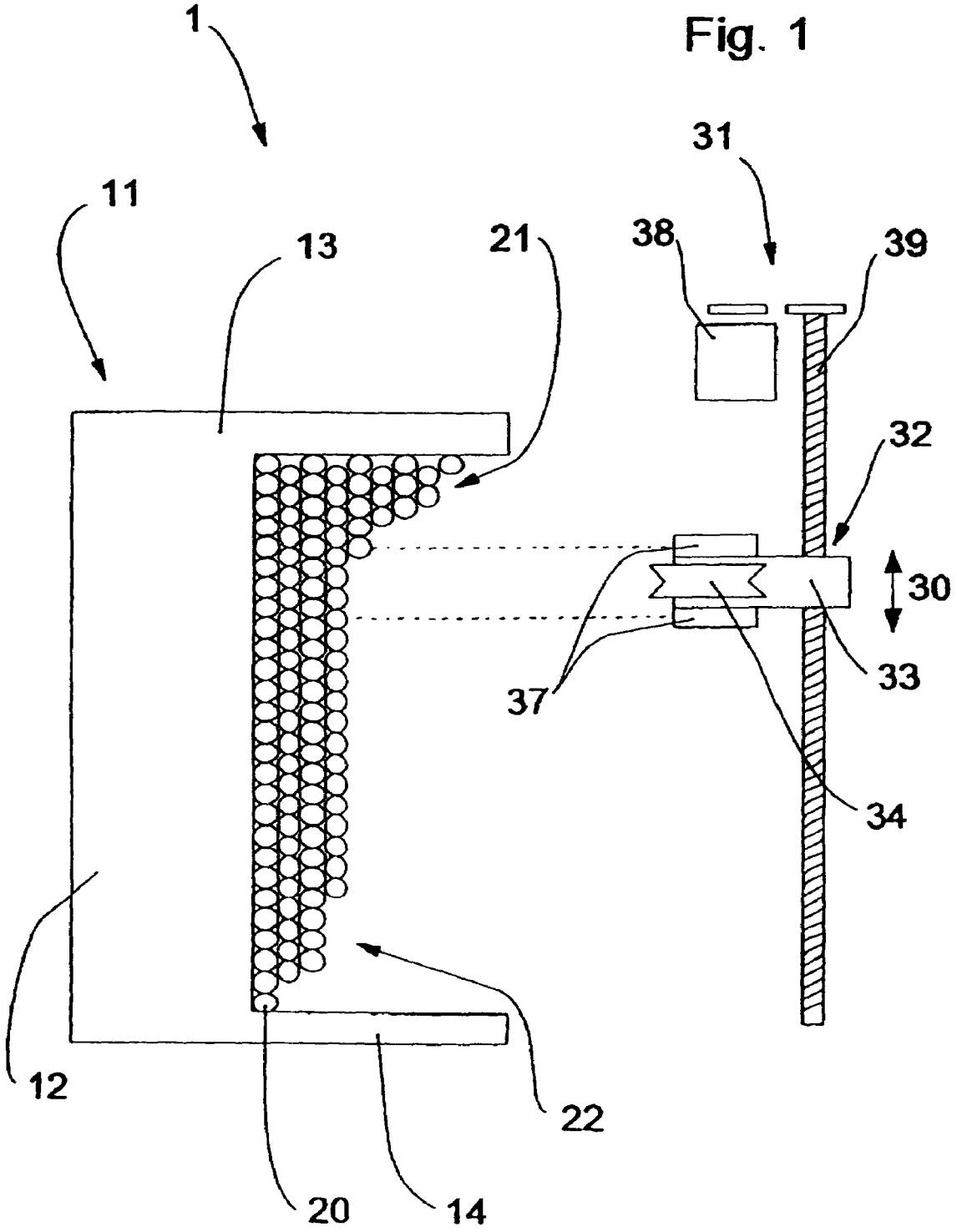
FIG. 1 shows a schematic cross-section through a winding device for executing the method according to the present invention.

FIG. 1 shows a schematic cross-section through a winding device 1 for carrying out the method according to the present invention. In the Figure, at the left the right half of a winding spool 11 is shown, made up of spool core 12 and the two flanges 13 and 14, in section. The object of the method according to the present invention is to wind spool core 12 with elongated winding material 20 as uniformly as possible, in order to make optimal use of the winding volume of winding spool 11. In the Figure, the depicted examples of undesirable valleys are designated 22 and the hills are designated 21.

Laying device 31 is shown at the right in FIG. 1. Laying unit 32 is mounted on a spindle axle 39. A rotational movement of spindle axle 39 clockwise or counterclockwise effects a movement of laying unit 32 in a direction essentially parallel to the spool axis, indicated by double arrow 30. Spindle axle 39 is driven by motor 38. Laying unit 32 has a carriage 33 on which deflecting roller 34 and sensor unit 37 are situated.

During the laying of the winding material on the spool, this material is guided to winding spool 11 via deflecting roller 34. For the uniform distribution of the winding material on the spool, laying unit 32 is moved by motor 38 and spindle axle 39.

In the method, the already-laid winding and the spool are measured by sensor unit 37. The sensor unit is capable of acquiring spool flange 13 and 14, as well as the winding diameter of the already-laid layer. In a preferred specific embodiment, the optical sensors of sensor unit 37 operate according to the triangulation method, and thus do not require a reflector.

Sensor unit 37 is also used to recognize the position of the spool flange. Every time there is a laying stroke, on the basis of the changes in the measurement values the sensor unit determines the position of the flange and uses it for the subsequent reversal of direction. As an alternative to the use of two sensors situated at both sides of the deflecting roller, the method can also operate with one sensor unit made up of only one sensor. In this case, the sensor unit must be constructed such that this one sensor is capable of being moved or pivoted towards the reverse points during operation.

Figure 2:
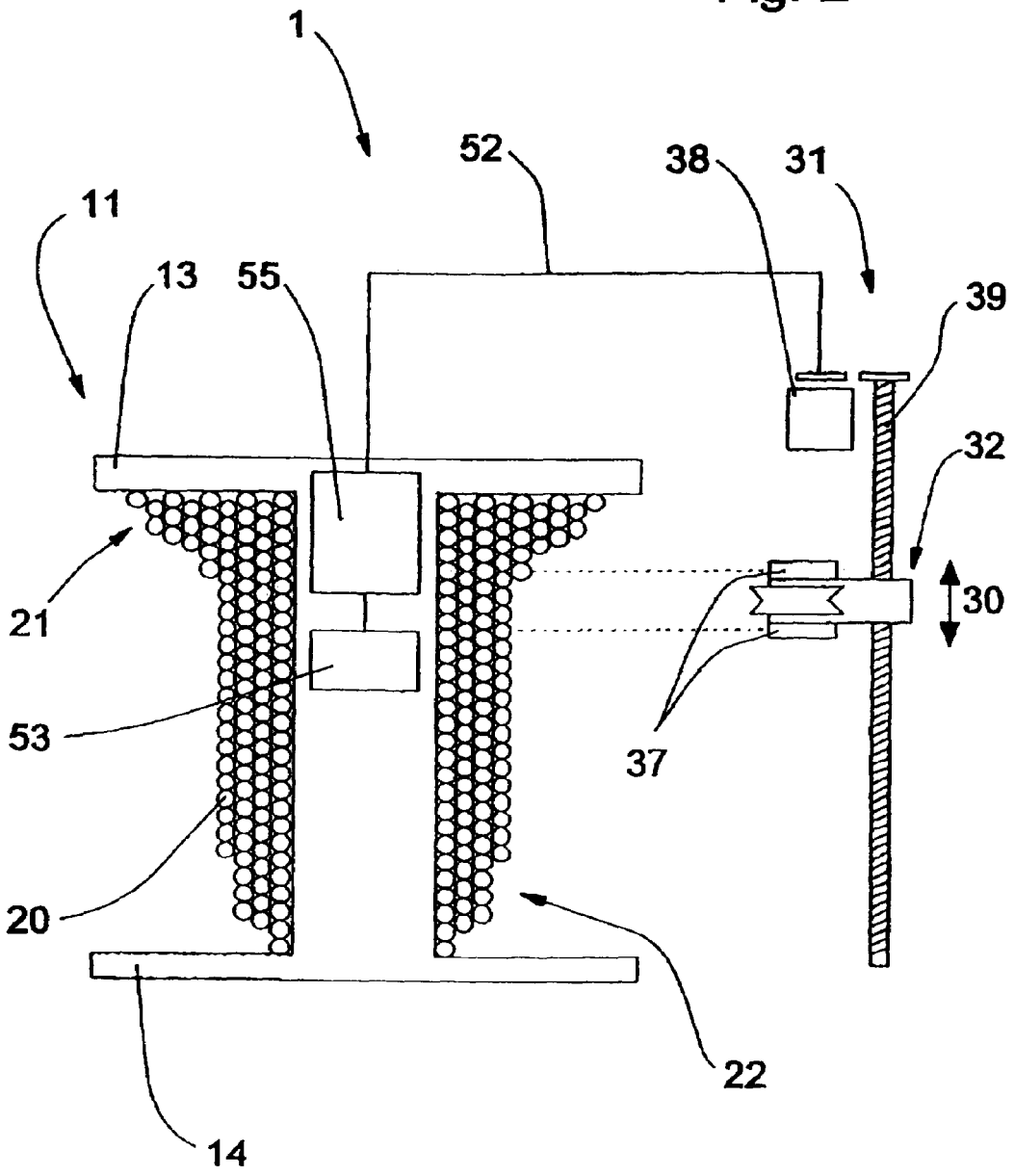
FIG. 2 shows the arrangement of control elements of the device for carrying out the method according to the present invention for the example of a bunching machine.

FIG. 2 shows device 1 for carrying out the method according to the present invention, in which the data-processing elements of control device 51 are largely built into the spool carriage. In this specific embodiment of the device, control device 51 has a microprocessor computing unit 55 as well as a storage device 53 allocated to this computing unit. In the bunching machine, shown as an example, the supply of energy and the exchange of signals between the elements of control device 51 is particularly difficult to realize, because the energy supplying and the signal exchange are possible only via a rotating shaft. The connecting line to motor 38 of laying device 31 is shown for example by line 52 in FIG. 2. The representation of the remaining elements of control device 51, shown schematically in FIG. 3, is omitted in FIG. 2 for reasons of simplicity.

Figure 3:
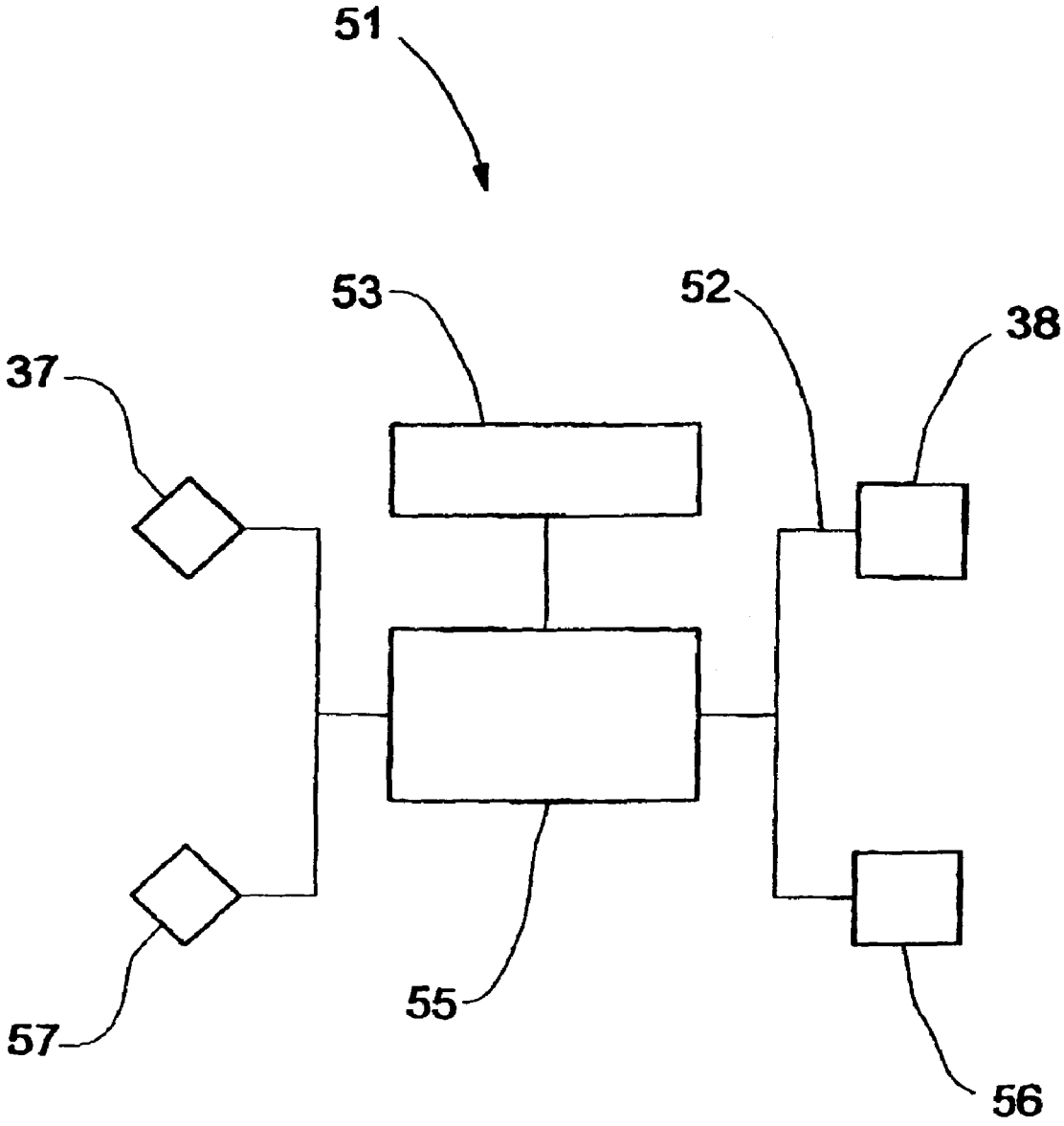
FIG. 3 shows a schematic block diagram of the control device.

FIG. 3 shows a schematic block switching diagram of control device 51 for the method according to the present invention. The input values of microprocessor unit 55 are essentially acquired by sensor unit 37 and by speed measurement device 57 for the feeding of the winding material. Microprocessor computing unit 55 is connected to a storage device 53 that can be partitioned into arbitrarily many storage areas, including different ones. In this storage device 23 there is stored a program that controls microprocessor computing unit 55. From the input data of sensor unit 37 and of speed measurement device 57 for the feeding of the winding material, microprocessor computing unit 55 derives the control signals for motor 38 of spindle axle 39, as well as for winding drive 56, which in the bunching machine (described as an example) drives winding spool 11.

Control device 51 used in the method according to the present invention contains a discrete interface to standard drive systems. In the case of the bunching machine (in relation to which the method according to the present invention is shown as an example) this is a step motor solution that is controlled using analog and digital signals. In addition, via this interface there takes place an acquisition of the actual position value for the positioning module. As an additional interface to the drive, control device 51 has a CAN bus interface. In the preferred specific embodiment, the communication takes place via interface RS485. A Profibus control unit is provided for communication with standard controlling types.

The invention claimed is:

1. A method for laying elongated strand-like winding material, comprising: winding the strand-like material in layers onto at least one rotationally symmetrically shaped winding spool; guiding the winding material to one said winding spool via a deflecting roller for the laying, and for the distribution of the winding material on said winding spool; moving the deflecting roller on a laying device at least essentially parallel to the axial direction; providing a sensor unit that acquires the position of a spool flange, as well as the winding diameter of the winding material; and deriving control signals for the movement of the deflecting roller from the measurement values of the sensor unit.

2. The method as recited in claim 1, wherein a feeding speed of the winding material is acquired by a speed measurement device, and from this value, as well as from the measurement values of the sensor unit, control signals are derived for the movement of the deflecting roller.

3. The method as recited in claim 1 wherein said winding spool rotates during the winding process.

4. The method as recited in claim 1 wherein said winding spool stands still during the winding process, and the laying device rotates around said winding spool.

5. The method as recited in claim 1 wherein reverse points on the spool flanges are determined by the sensor device, and the direction of laying is reversed as soon as a signal of the sensor unit indicates that the side of the spool flange facing the spool core has been reached.

6. The method as recited in claim 1 wherein a shape and a type of the winding spool are determined from the signals of the sensor unit.

7. A device for carrying out the method as recited in claim 1 for laying elongated winding material on a rotationally symmetrical spool core provided with flanges, on which a first and a second flange are situated, and on a laying device to which a laying unit is allocated that moves essentially parallel to the direction of the spool axis relative to the laying device, wherein the winding material is guided to the winding spool via a deflecting roller that is situated on the laying unit, and the laying unit is assigned a sensor unit that acquires at least the position of the spool flange as well as the winding diameter of the already-laid winding material.

8. The device as recited in claim 7, wherein the laying unit is moved on a spindle axle.

9. The device as recited in claim 8, wherein the spindle axle is rotated by a motor.

10. The device as recited in claim 7 further including a control device.

11. The device as recited in claim 10, wherein the control device has a sensor unit and a speed measurement device for the feeding of the winding material.

12. The device as recited in claim 11, wherein the spool angle or winding material angle are determined from the measurement values of the sensor unit.

13. The device as recited in claim 7 wherein the control device has a microprocessor computing unit that is controlled by a program that is stored in a storage device allocated to the microprocessor computing unit.

14. The device as recited in claim 7 wherein the motor and the winding drive are controlled by the control device.

15. The device as recited in claim 7 wherein the sensor unit contains at least one optical sensor.

16. The device as recited in claim 7 wherein when only one optical sensor is allocated to the sensor unit, the sensor of this sensor unit is constructed so as to be capable of being moved or pivoted toward the reverse points.

* * * * *